US007499561B2

(12) United States Patent
Hanses et al.

(10) Patent No.: US 7,499,561 B2
(45) Date of Patent: Mar. 3, 2009

(54) HEARING AID WITH CERUMEN PROTECTION

(75) Inventors: Thomas Hanses, Feldkirchen-Westerham (DE); Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 570 days.

(21) Appl. No.: 11/126,094

(22) Filed: May 10, 2005

(65) Prior Publication Data

US 2005/0271229 A1 Dec. 8, 2005

(30) Foreign Application Priority Data

May 11, 2004 (DE) ..... 10 2004 023 306

(51) Int. Cl.
*H04R 25/00* (2006.01)
*H04R 25/02* (2006.01)

(52) U.S. Cl. ..... 381/325; 381/324; 381/328; 181/130

(58) Field of Classification Search ..... 381/325, 381/328, 312, 322, 330, 380; 128/864, 867; 181/129, 130, 135
See application file for complete search history.

(56) References Cited

U.S. PATENT DOCUMENTS

| | | | | | |
|---|---|---|---|---|---|
| 3,702,123 | A * | 11/1972 | Macken | 181/135 |
| 5,970,157 | A * | 10/1999 | Yoest | 381/325 |
| 6,000,492 | A * | 12/1999 | Puthuff et al. | 181/135 |
| 6,134,333 | A | 10/2000 | Flagler | |
| 7,267,847 | B2 * | 9/2007 | Karamuk | 427/569 |
| 2003/0007991 | A1 * | 1/2003 | Masters | 424/423 |
| 2004/0161445 | A1 * | 8/2004 | Bulk et al. | 424/423 |

FOREIGN PATENT DOCUMENTS

DE 102 19 679 A1 11/2003

* cited by examiner

*Primary Examiner*—Curtis Kuntz
*Assistant Examiner*—Jesse A Elbin

(57) ABSTRACT

The cleaning and exchange of components of the hearing aid which is necessary at regular intervals due to the conventional contamination is uncomfortable and expensive. The housing (G) and any protective devices (K) which are to protect from contamination, are provided with a dirt-resistant layer. In this way, the dirt adheres less strongly to the hearing aid, so that if necessary it can be removed by means of tapping.

10 Claims, 1 Drawing Sheet

HEARING AID WITH CERUMEN PROTECTION

CROSS REFERENCE TO RELATED APPLICATIONS

This application claims priority to the German application No. 10 2004 023 306.3, filed May 11, 2004 which is incorporated by reference herein in its entirety.

FIELD OF INVENTION

The present invention relates to a hearing aid with a housing which has at least one opening, and a protective device, arranged in or on the opening to prevent contamination getting into the opening and/or to facilitate the cleaning of the opening.

BACKGROUND OF INVENTION

The daily use of hearing aids exposes them to a very wide variety of substances, which can cause contamination in the devices and particularly in the converters of the devices. Such substances are sweat and cerumen in particular. The contaminations within the converter, namely the microphone and the receiver, result in high service costs, since the contaminated converters must be cleaned and in the worst case even exchanged.

As is known, the contamination problem can additionally be solved by cerumen protection grid attached in front of the converters. Nevertheless, these also quickly accumulate dirt and must be cleaned or exchanged. Furthermore devices made by Phonak are available on the market in which a protective membrane is stretched in front of the microphone openings in each instance. This protective membrane is intended to keep the dirt out of the microphones.

SUMMARY OF INVENTION

This known solution is disadvantageous in that grids or membranes still have to be cleaned or exchanged.

A cerumen protective device is known from patent application U.S. Pat. No. 6,134,333 A, in which a membrane is stretched across a louver. The membrane consists of a hydrophobe or oleophobe material.

Furthermore, the publication DE 102 19 679 A1 discloses a hearing aid or hearing aid components for use in the auditory canal and/or the pinna of a wearer. The hearing aid or the hearing aid component is provided with a biofilm-inhibiting coating, by means of which a coating of cerumen is to be formed on the hearing aid and/or on the hearing aid component.

An object of the present invention is thus to propose a hearing aid which has improved protection against contamination.

According to the invention, this object is achieved by means of a hearing aid with a housing comprising at least one opening, and a protective device arranged in or on the opening, in order to prevent contamination getting into the opening and/or to facilitate the cleaning of the opening, a cone being arranged in at least one opening, the tip of which points to the interior of the hearing aid housing. In this way, the opening is particularly protected from large cerumen particles.

Advantageously this means that no dirt accumulates on the housing and/or on the protective device for the opening. The dirt can be removed from the opening in a simple manner by means of tapping.

The housing and/or the protective device is preferably coated with a protective layer which is resistant to cerumen or sweat. In this way, the main contaminating substances which are accumulating cannot adsorb in the hearing aid openings.

Furthermore, the protective layer can be a layer which is manufactured using chemical nanotechnology and comprises hydrophobe or oleophobe characteristics. This is advantageous in that the geometry of the opening and/or the protective device is not influenced by the coating, since the thickness of the coating is in the nanometer range.

The protective coating can further comprise antibacterial characteristics. This can be guaranteed in particular by the inclusion of silver ions. This means that the auditory canal and the eardrum have improved protection from inflammations.

In a particular embodiment, the protective device can be formed by the shape of the opening itself. The cross-section of the opening from the housing exterior wall to the housing interior wall can decrease in particular. This enables contamination found in the opening to be easily removed.

The at least one opening can be a sound outlet, a sound inlet or a ventilation channel. This is to symbolize that each opening of a hearing aid can essentially be protected by means of the technology mentioned.

The hearing aid according to the invention can be an in-the-ear (ITE) device or a behind-the-ear hearing (BTE) device. In the case of the ITE device, the protective device is directly arranged on the hearing aid housing, whereas in the case of the BTE device, the protective device is affixed in the molded earpiece and/or to its opening. Each opening of any hearing aid can thus be protected by means of the method according to the invention.

BRIEF DESCRIPTION OF THE DRAWINGS

The present invention is now described in more detail with reference to the accompanying drawings, in which.

The exemplary embodiment illustrated below represents a preferred embodiment of the present invention.

DETAILED DESCRIPTION OF INVENTION

A hole B is provided in the housing G of the hearing aid. A converter W, a receiver or microphone for instance, is arranged below the hole B. An attenuation ring D is positioned between the hole interior wall and the cylindrical part of the converter W which protrudes into the hole B in order to fix the converter W into the hole B in an attenuating manner. The opening cross-section of the attenuation ring D increases starting from the front end of the converter W outwards and/or tapered upwards.

Figure 1:
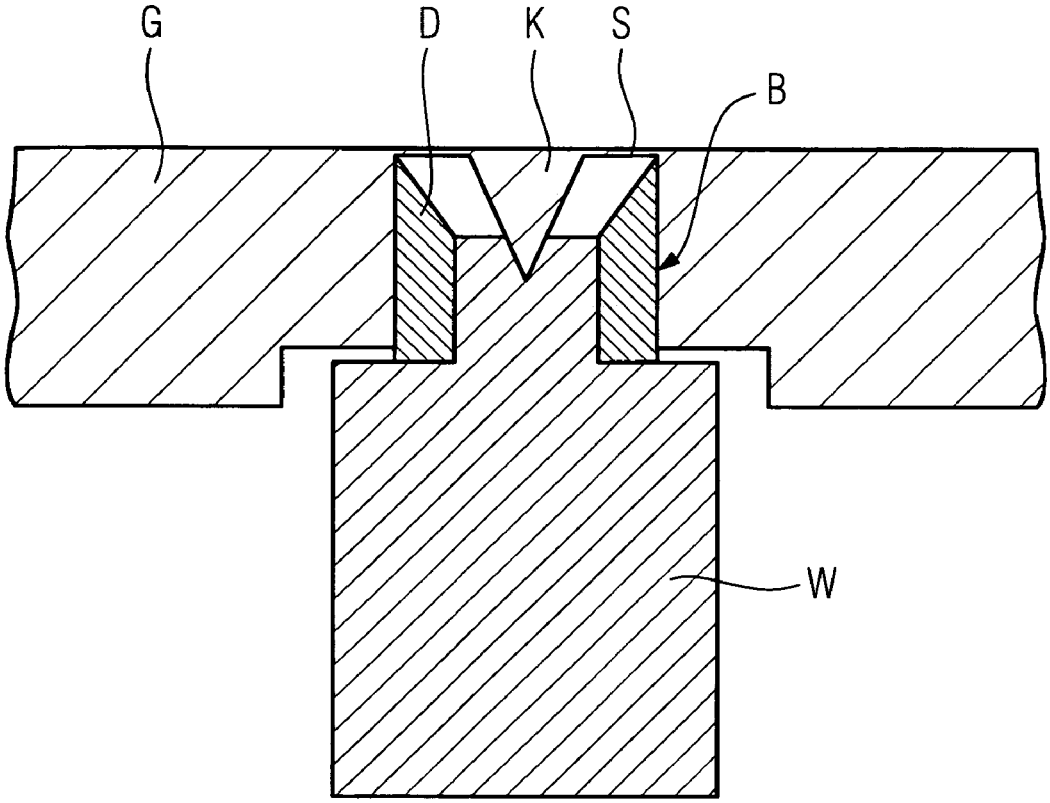
FIG. 1 shows a cross-section through a hearing aid opening which is protected according to the invention, and FIG. 2 a top view of the opening of FIG. 1.
Figure 2:
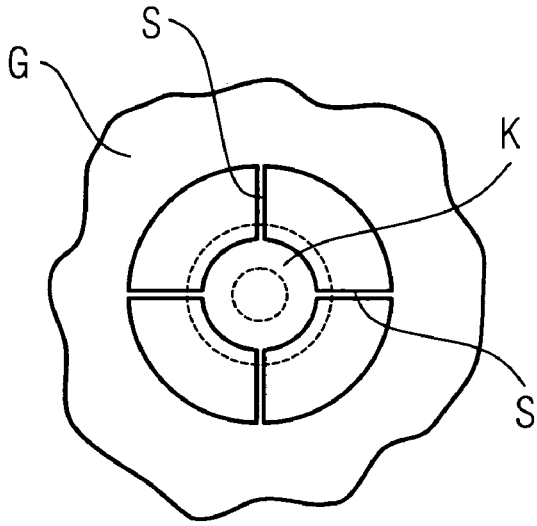

A cone K is attached centrically to the exterior side of the hole and is held in this position with the aid of supports S, as shown in particular in FIG. 2. The cone K is connected in one-piece to the housing G thereby representing an injection molded part. Furthermore, the cone K can extend into a part in the converter W.

The angle of the cone K is designed such that the entire opening cross-section to the converter W reduces in conjunction with the opening angle of the attenuation ring D. In this way, contamination particles in the opening can be easily removed. The cone K has no acoustic influence since the entire cross-section of the opening in the axial direction of the opening remains somewhat the same. In fact, the opening cross-section on all axial positions is large enough for the incoming and outgoing acoustic waves to pass through unhindered.

In the present example, the housing G and the cone K serving as a protective device, which are designed together as one-piece, are coated with a dirt-resistant protective layer. The outstanding feature of this protective layer is that the adhesive forces on the dirt particles are relatively low. In this way, the ceruman which is strongly adhesive on many other materials is barely able to accumulate on this protective layer. The same also applies to sweat for example. Those particles which nevertheless accumulate on the coated housing and/or the protective device can generally be removed by means of tapping.

The attenuation ring D or other components such as the converter W for example can be provided with the protective layer. This prevents dirt particles accumulating as heavily on these components.

The invention claimed is:

1. A hearing aid, comprising:

a housing for accommodating the hearing aid and having an opening;

a cone arranged within the opening via supports, the cone having a tip on a narrowmost end pointing into an interior of the bearing aid housing;

a converter having a cylindrical portion positioned within the opening of the housing; and an attenuation ring positioned between an interior wall of the housing and the cylindrical portion of the converter effective to fix the converter within the opening in an attenuating manner;

wherein the cone is disposed within an interior portion of the attenuation ring;

wherein the cone further comprises a tapering cross-section that continuously reduces in diameter from a front end of the cone to a rear end of the cone and from a front end of the opening to the converter: and wherein the attenuation ring further comprises an opening angle that reduces in inner diameter from a front end of the attenuation ring, the front end of the attenuation ring facing the opening.

2. The hearing device according to claim 1, wherein the housing or the cone are coated with a protective layer, the protective layer configured to resist cerumen or sweat.

3. The hearing aid according to claim 2, wherein the protective coating includes a layer having a hydrophobe or oleophobe property.

4. The hearing aid according to claim 3, wherein the protective coating is manufactured by utilizing nano technology.

5. The hearing aid according to claim 2, wherein the protective layer has an antibacterial property.

6. The hearing aid according to claim 5, wherein the protective layer includes silver ions.

7. The hearing aid according to claim 1, wherein the protective device has a shape fitting into the opening.

8. The hearing aid according to claim 7, wherein a cross-section of the opening declines, the cross-section measured along a direction from an exterior wall of the housing to an interior wall of the housing.

9. The hearing aid according to claim 1, wherein the opening is a sound outlet, a sound inlet, or a ventilation channel.

10. The hearing aid according to claim 1, wherein the hearing aid is designed as an ITE or BTB hearing aid.

* * * * *